US008054262B2

(12) United States Patent
Kim et al.

(10) Patent No.: US 8,054,262 B2
(45) Date of Patent: Nov. 8, 2011

(54) CIRCUIT FOR STABILIZING COMMON VOLTAGE OF A LIQUID CRYSTAL DISPLAY DEVICE

(75) Inventors: Jang-Hwan Kim, Gyeongsangbuk-Do (KR); Kyoung-Hun Lee, Gyeongsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 1039 days.

(21) Appl. No.: 11/636,592

(22) Filed: Dec. 11, 2006

(65) Prior Publication Data

US 2008/0001886 A1 Jan. 3, 2008

(30) Foreign Application Priority Data

Jun. 30, 2006 (KR) ..... 10-2005-061456

(51) Int. Cl.
*G09G 3/36* (2006.01)

(52) U.S. Cl. ..... 345/87

(58) Field of Classification Search ..... 345/87–104
See application file for complete search history.

(56) References Cited

U.S. PATENT DOCUMENTS

| | | | | |
|---|---|---|---|---|
| 6,025,752 | A * | 2/2000 | Zhou et al. | 330/51 |
| 2003/0058235 | A1 * | 3/2003 | Moon | 345/212 |
| 2006/0197621 | A1 * | 9/2006 | Jeon et al. | 331/167 |
| 2007/0001963 | A1 * | 1/2007 | Koma | 345/96 |

* cited by examiner

*Primary Examiner* — Amr Awad
*Assistant Examiner* — Jonathan Boyd
(74) *Attorney, Agent, or Firm* — McKenna Long & Aldridge, LLP

(57) ABSTRACT

A circuit for stabilizing a common voltage of a liquid crystal display device includes a data driving unit for providing video data to a liquid crystal display panel and a gate driving unit for providing scan pulses to the liquid crystal display panel, a timing controller for outputting various control signals for controlling the data driving unit and the gate driving unit, and outputting the video data, and a common voltage output unit for controlling outputting of a common voltage provided to the liquid crystal display panel according to a gate output enable signal inputted from the timing controller to thereby minimize the common voltage from being unstable.

15 Claims, 3 Drawing Sheets

CIRCUIT FOR STABILIZING COMMON VOLTAGE OF A LIQUID CRYSTAL DISPLAY DEVICE

This application claims the benefit of Korean Patent Application No. 2005-061456, filed on Jun. 30, 2006, which is hereby incorporated by reference for all purposes as if fully set forth herein.

BACKGROUND OF THE INVENTION

1. Field of the Invention

The present invention relates to a technique for stabilizing a common voltage supplied to a liquid crystal display panel of a liquid crystal display (LCD) device and, more particularly, to a circuit for stabilizing a common voltage of an LCD capable of minimizing generation of a panel blur (mura) resulting from a common voltage becoming unstable due to a capacitance component within a panel.

2. Description of the Related Art

In general, because the LCD has characteristics that it is light and thin and driven at low power consumption, its use has extended to office automation devices or an audio/video device. The LCD displays a desired image on its screen by controlling transmittance of a light according to image signals applied to a plurality of control switches arranged in a matrix form.

FIG. 1 is a schematic block diagram of an LCD according to a related art. As illustrated, the related art LCD includes a liquid crystal display panel 13 in which a plurality of data lines DL and a plurality of gate lines GL cross and thin film transistors (TFTs) for driving liquid crystal cells are formed at crossing points of the data lines and the gate lines; a data driving unit 11 for providing data to the data lines DL; a gate driving unit 12 for providing scan pulses to the gate lines GL; and a timing controller 14 for outputting various control signals for controlling the data driving unit 11 and the gate driving unit 12 and outputting video data (R, G and B).

The operation of the LCD will now be described with reference to FIGS. 2 and 3.

The liquid crystal display panel 13 is constructed such that liquid crystal is provided between two glass substrates, and the data lines DL and the gate lines GL cross on the lower glass substrate. TFTs formed at the crossing points of the data lines DL and the gate lines GLS provide data received from the data lines DL to liquid crystal cells in response to scan pulses from the gate lines GL. For this purpose the gate terminal of each TFT is connected with a respective gate line GL and the source terminal of each TFT is connected with a respective data line DL. A drain terminal of each TFT is connected with a respective pixel electrode of each liquid crystal cell Clc. A storage capacitor Cst for sustaining a voltage of liquid crystal cells is formed on the lower glass substrate of the liquid crystal display panel 13.

The timing controller 14 receives digital video data (RGB), a horizontal synchronization signal Hsync, a vertical synchronization signal Vsync and a clock signal CLK; generates a gate control signal GDC for controlling the gate driving unit 12; and generates various data control signals DDC for controlling the data driving unit 11. In addition, the timing controller 14 serves to transfer data provided from an external system to the data driving unit 11.

The gate driving unit 12 includes a shift register for sequentially generating scan pulses in response to the gate control signal GDC from the timing controller 14, a level shifter for shifting a swing width of the scan pulse into a level suitable for driving the liquid crystal cell Clc, and an output buffer, etc.

The gate driving unit 12 provides the scan pulses to the gate lines GL to turn on the TFTs connected with the gate lines GL, and accordingly, to select liquid crystal cells Clc of one horizontal line to which a pixel voltage, namely, an analog gamma compensation voltage, is to be supplied. Data generated from the data driving unit 11 are provided to the liquid crystal cells Clc of the selected horizontal line by the scan pulse.

The data driving unit 11 provides data to the data lines DL in response to a data drive control signal DDC provided from the timing controller 14. The data driving unit 11 samples the digital data RGB from the timing controller 14, latches it, and then, converts it into an analog gamma voltage.

For reference, in the above description, the data driving unit 11 and the gate driving unit 12 are separately installed on the liquid crystal display panel 13. In this respect, recently, the data driving unit 11 and the gate driving unit 12 may be integrated into a plurality of ICs and mounted on a TCP (Tape Carrier Package) so as to be connected to the liquid crystal splay panel 33 in a TAP (Table Automated Bonding) method or mounted on the liquid crystal display panel 33 in a COG (Chip On Glass) method.

FIG. 2 illustrates a circuit for generating a common voltage Vcom provided to each liquid crystal cell Clc on the liquid crystal display panel 13. As shown, a resistor R21, a variable resistor VR21 and a resistor R22 are connected in series between a power source terminal Vdd and a ground terminal GND and the common voltage Vcom is outputted from a contact between the resistor R21 and the variable resistor VR21.

Accordingly, the common voltage Vcom is outputted as a level of a DC voltage divided by the resistor R21, the variable VR21 and the resistor R22, and the level can be adjusted by the variable resistor VR21.

The common voltage Vcom may be provided as a DC voltage in a stable form, namely, a DC voltage of a pre-set level, in any situation. However, coupling occurs due to a capacitance component on the liquid crystal display panel 13. As illustrated in FIG. 3, the common voltage Vcom becomes unstable in a blanking interval during which there is no data because of the capacitance component, such as the liquid crystal cell Clc, the storage capacitor Cst, or a Cgs.

Thus, a panel blur phenomenon or a horizontal crosstalk (C/T), etc. is generated to degrade picture quality.

SUMMARY OF THE INVENTION

Accordingly, the present invention is directed to a circuit for stabilizing common voltage of a liquid crystal display device that substantially obviates one or more of the problems due to limitations and disadvantages of the related art.

An advantage of the present invention is to provide a circuit for stabilizing a common voltage capable of providing a common voltage in a stable state regardless of conditions of a liquid crystal display panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a liquid crystal display panel comprises a liquid crystal display panel; a data driving unit; a gate driving unit; a timing controller; a common voltage generator; and a common voltage output controller having a switch between the common voltage generator and a common electrode of the liquid crystal display panel to connect the common voltage generator to the common electrode when a data signal is applied to a pixel electrode of the liquid crystal display panel.

According to another aspect of the present invention, a method of driving a liquid crystal display includes applying a common voltage to a common electrode when a gate signal is in a first state; and preventing application of a common voltage to the common electrode when the gate signal is in a second state.

In another aspect of the present invention, a method of driving a liquid crystal display includes applying a common voltage to a common electrode when a data signal is applied to a pixel electrode; and preventing application of a common voltage to the common electrode when a data signal is not applied to the pixel electrode.

In yet another aspect of the present invention, a common voltage output unit comprises a common voltage generator; and a common voltage output controller to connect the common voltage generator to a common electrode when a data signal is applied to a pixel electrode.

In yet another aspect of the present invention, a common voltage output unit comprises a common voltage generator; and a common voltage output controller having a switch between the common voltage generator and a common electrode to connect the common voltage generator to the common electrode when a data signal is applied to a pixel electrode.

In another aspect of the present invention, a driving circuit of a liquid crystal display device comprises a data driving unit for providing video data to a liquid crystal display panel and a gate driving unit for providing scan pulses to the liquid crystal display panel; a timing controller for outputting various control signals for controlling the data driving unit and the gate driving unit, and outputting the video data; and a common voltage output unit for controlling outputting of a common voltage provided to the liquid crystal display panel according to a gate output enable signal inputted from the timing controller.

A method of driving a common voltage of a liquid crystal display device, comprises providing video data and scan pulses to a liquid crystal display panel and a gate driving unit for providing scan pulses to the liquid crystal display panel; providing various control signals including a gate output enable signal for controlling a data driving unit and a gate driving unit of the liquid crystal display panel and for outputting the video data; and generating a common voltage output unit for controlling outputting of a common voltage provided to the liquid crystal display panel according to the gate output enable signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

A circuit for stabilizing a common voltage of a liquid crystal display device according to the present invention will be described with reference to the accompanying drawings.

Figure 1:
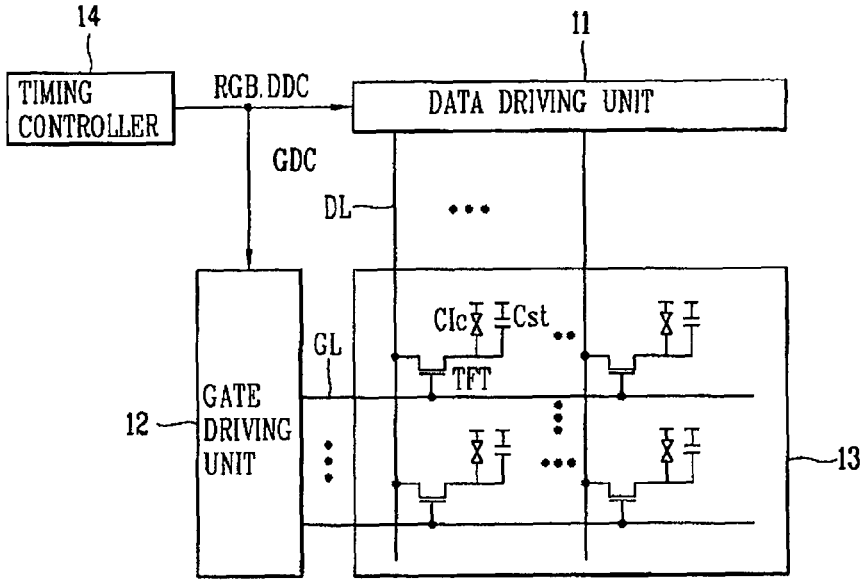
FIG. 1 RELATED ART
FIG. 1 is a schematic block diagram of a liquid crystal display device according to a related art.
Figure 2:
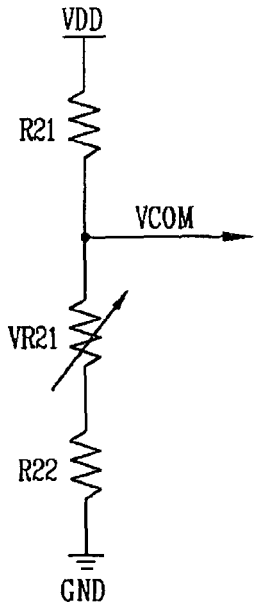
FIG. 2 RELATED ART
FIG. 2 is a circuit for generating a common voltage according to the related art.
Figure 3:
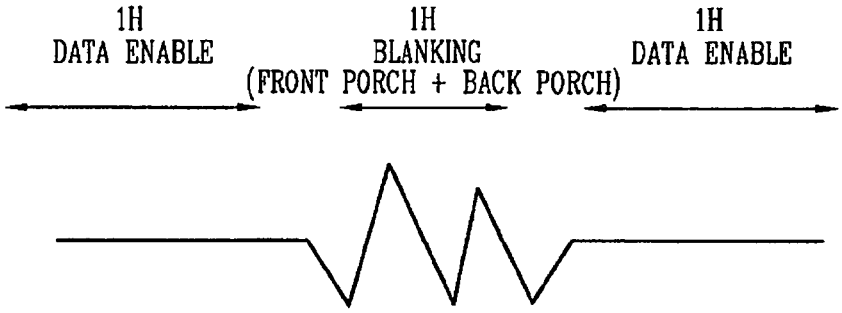
FIG. 3 RELATED ART
FIG. 3 is a waveform view of the common voltage in the LCD according to the related art.
Figure 4:
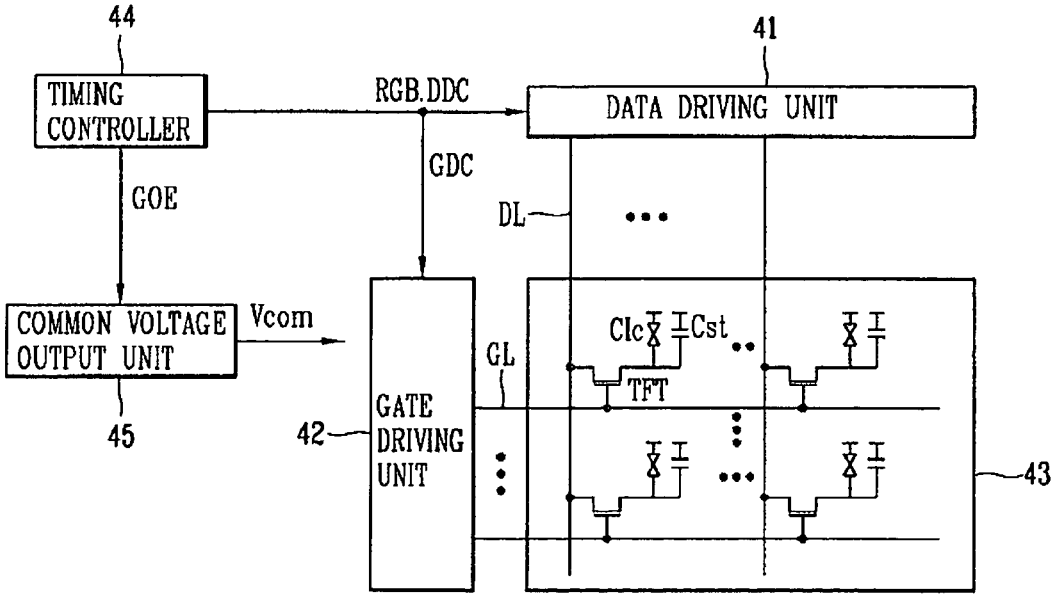
FIG. 4 is a schematic block diagram of a circuit for stabilizing a common voltage in an LCD according to the present invention.

FIG. 4 is a schematic block diagram of a circuit for stabilizing a common voltage in an LCD according to the present invention. As illustrated in FIG. 4, the circuit for stabilizing a common voltage in an LCD includes a liquid crystal display panel 43 having a plurality data lines DL and a plurality of gate lines GL that cross each other and having TFTs formed at the crossing points thereof for driving liquid crystal cells; a data driving unit 41 for providing data to the data lines DL; a gate driving unit 42 for providing scan pulses to the gate lines GL; a timing controller 44 for outputting various control signals for controlling the data driving unit 41 and the gate driving unit 42 and outputting video data (R, G and B); and a common voltage output unit 45 for controlling an output of a common voltage Vcom according to a timing control signal, for example, a gate output enable signal GOE, inputted from the timing controller 44, where the common voltage output controller includes a switch that may be operable according to the timing control signal.

Figure 5:
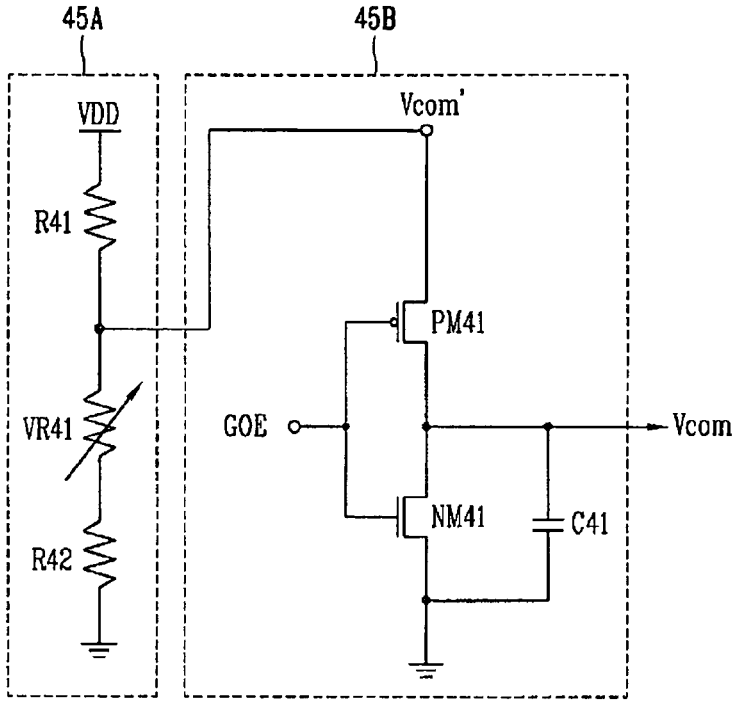
FIG. 5 is a detailed circuit diagram of a common voltage output unit in FIG. 4.

FIG. 5 is a detailed circuit diagram illustrating an embodiment of the common voltage output unit 45 in FIG. 4. As illustrated in FIG. 5, the common voltage output unit 45 includes a common voltage generator 45A for generating a common voltage Vcom' of a certain level using a resistor R41, a variable resistor VR41 and a resistor R42 between a power source terminal Vdd and a ground terminal GND; and a common voltage output controller 45B for inverting the common voltage Vcom' outputted from the common voltage generator 45A according to a timing control signal like the gate output enable signal GOE inputted from the timing controller 44 and outputting a common voltage Vcom.

Referring to FIG. 4, in the liquid crystal display panel liquid crystal is provided between two glass substrates. The data lines DL and gate lines GL cross each other on the lower glass substrate. The TFTs formed at crossing points of the data lines DL and the gate lines GL provide data from the data lines DL to liquid crystal cells in response to scan pulses from the gate lines GL. For this purpose, the gate terminal of each TFT is connected with a respective gate line GL and its source terminal is connected with a respective data lines DL. A drain terminal of each TFT is connected with a respective pixel electrode of the liquid crystal cells Clc. In addition, a storage capacitor Cst for sustaining a voltage of the liquid crystal cells is formed on the lower glass substrate.

The timing controller 44 receives digital video data RGB, a horizontal synchronization signal Sync, a vertical synchronization signal Vsync and a clock signal CLK, generates a gate control signal GDC for controlling a gate driving unit 42, and also generates various data control signals DDC for controlling the data driving unit 41. In addition, the timing controller 44 serves to transfer the data RGB provided from the system to the data driving unit 41.

As illustrated, the gate driving unit 42 includes a shift register for sequentially generating scan pulses in response to gate control signals GDC from the timing controller 44, a level shifter for shifting a swing width of the scan pulses to a level suitable for driving the liquid crystal cells Clc, and an output buffer, etc. The gate driving unit 42 provides scan pulses to the gate lines GL to turn on the TFTs connected with the gate lines, and accordingly, liquid crystal cells Clc of one horizontal line to which the pixel voltage, namely, the analog gamma compensation voltage, is to be provided is selected. The data generated from the data driving unit 41 is provided to the liquid crystal cells Clc of the horizontal line selected by the scan pulses.

The data driving unit 41 provides data to the data lines DL in response to the data driving control signal DDC provided from the timing controller 44. The data driving unit 41 samples the digital data RGB from the timing controller 44, latches it and converts it into an analog gamma voltage.

Figure 6A:
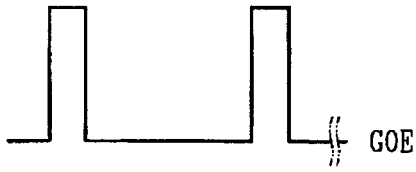
FIGS. 6A and 6B are waveform views of gate output enable signal and common voltage.
Figure 6B:
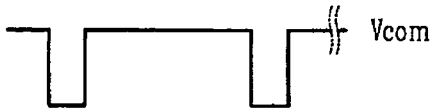

The common voltage output unit 45 controls an output of the common voltage Vcom according to the gate output enable signal GOE inputted from the timing controller 44 to maintain the common voltage Vcom stably. An operation of the common voltage output unit 45 will now be described in detail with reference to FIGS. 5 and 6.

The common voltage generator 45A may include a resistor R41, a variable resistor VR41 and a resistor R42 connected in series between the power source terminal VDD and the ground terminal GND, and a common voltage Vcom' is outputted from a contact point (node) of the resistor R41 and the variable resistor VR41.

Accordingly, the common voltage Vcom' is outputted with a level of a DC voltage divided by the resistor R41, the variable resistor VR41 and the resistor R42, and the level can be controlled by the variable resistor VR41.

In this case, if the common voltage Vcom' outputted from the common voltage generator 45A is provided as it is to the liquid crystal display panel 43, the common voltage Vcom' becomes unstable in a blanking interval during which data is not provided due to a capacitance component such as the liquid crystal cells Clc, the storage capacitor Cst or Cgs, etc.

Thus, in the present invention, in the blanking interval during which data is not provided, the supply of the common voltage Vcom' to the liquid crystal display panel 43 is prevented. This can be implemented in various manners, and the common voltage output controller 45B shows one of these embodiments.

That is, in one aspect of the present invention, an inverter or switch is constructed with a PMOS transistor PM41 and an NMOS transistor NM41, the common voltage Vcom' is provided as a power source terminal voltage of the inverter and the gate output enable signal GOE is provided as an input terminal of the inverter or switch.

Accordingly, when the gate output enable signal GOE is outputted (active), namely, at the blanking interval during which data is not provided, outputting of the common voltage Vcom' is prevented. And at a time point when the gate output enable signal GOE is cut off (non-active), namely, at an interval during which data is provided, the common voltage Vcom' is outputted.

In this manner, by preventing outputting of the common voltage Vcom' at the blanking interval during which data is not provided, the common voltage Vcom can be prevented from being unstable due to the capacitance component such as the liquid crystal cells Clc, the storage capacitor Cst and Cgs, etc.

By connecting a condenser C41 between the common voltage Vcom and the ground terminal, the output state of the common voltage can be stabilized.

For reference, the LCD can be divided into three types of a TN (Twisted Nematic) mode LCD, an MVA (Multi-domain Vertical Alignment) mode LCD and an IPS (In-Plane Switching) mode LCD, etc., and the present invention can be applied to all the types of LCDs.

In the above-described embodiment, the common voltage output unit 45 is installed at a separate area, but it can be also included in the gate driving unit 42.

As so far described, the circuit for stabilizing the common voltage in the LCD according to the present invention has such advantages that, by preventing outputting of the common voltage at the blanking interval during which data is not provided, the phenomenon that the common voltage becomes unstable due to the capacitance component such as the liquid crystal cells, the storage capacitor and Cgs, etc. can be minimized, and thus, panel deficiency such as a horizontal crosstalk can be minimized.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel;

a data driving unit;

a gate driving unit;

a timing controller;

a common voltage generator; and a common voltage output unit comprising a common voltage generator generating a common voltage having predetermined level, and a common voltage output controller controls an output of the common voltage according to a gate output enable signal inputted from the timing controller, wherein the common voltage output controller prevents application of the common voltage to a common electrode when the gate output enable signal is in a first state and a data signal is not applied to a pixel electrode, and applies the common voltage to the common electrode when the gate output enable signal is in a second state and the data signal is applied to the pixel electrode, wherein the common voltage output unit prevents outputting of the common voltage at a blanking interval during which data is not provided.

2. A method of driving a liquid crystal display, comprising:

applying an inverted common voltage to a common electrode according to a gate output enable signal when a data signal is applied to a pixel electrode; and preventing application of the common voltage to the common electrode according to the gate output enable signal when the data signal is not applied to the pixel electrode, wherein the data signal is not applied during a blanking pulse.

3. The method of claim 2, wherein a data signal is applied to a pixel electrode, the gate output enable signal is a low state.

4. The method of claim 2, wherein the data signal is not applied to the pixel electrode, the gate output enable signal is a high state.

5. The method of claim 2, wherein the applying a common voltage is provided by connecting the common electrode to a common voltage generator when the data signal is applied to the pixel electrode.

6. The method of claim 2, wherein the data signal is supplied to the pixel electrode in response to the gate output enable signal.

7. The method of claim 2, wherein the gate output enable signal controls a switch to connect the voltage generator to the common electrode.

8. A common voltage output unit, comprising:

a common voltage generator generating a common voltage having predetermined level; and a common voltage output controls an output of the common voltage according to a gate output enable signal inputted from the timing controller, wherein the common voltage output controller prevents application of the common voltage to a common electrode when the gate output enable signal is in a first state and a data signal is not applied to a pixel electrode, and applies the common voltage to the common electrode when the gate output enable signal is in a second state and the data signal is applied to the pixel electrode, wherein the common voltage output unit prevents outputting of the common voltage at a blanking interval during which data is not provided.

9. The common voltage output unit of claim 8, wherein the common voltage output controller includes at least one transistor connected to a timing control signal.

10. A driving circuit of a liquid crystal display device comprising:

a data driving unit for providing video data to a liquid crystal display panel and a gate driving unit for providing scan pulses to the liquid crystal display panel;

a timing controller for outputting various control signals for controlling the data driving unit and the gate driving unit, and outputting the video data; and a common voltage output unit for controlling outputting of a common voltage provided to the liquid crystal display panel according to a gate output enable signal inputted from the timing controller, wherein the common voltage output unit prevents outputting of the common voltage at a blanking interval during which data is not provided.

11. The circuit of claim 10, wherein the common voltage output unit comprises:

a common voltage generator for generating a common voltage of a certain level by using resistors connected in series; and a common voltage output controller for inverting the common voltage outputted from the common voltage generator according to the gate output enable signal inputted from the timing controller, and outputting the inverted common voltage.

12. The circuit of claim 11, wherein the serially connected resistors are connected between a power source terminal and a ground terminal.

13. The circuit of claim 11, wherein one of the serially connected resistors is a variable resistor.

14. The circuit of claim 11, wherein the common voltage output controller comprises a PMOS transistor and an NMOS transistor connected in series between the common voltage generator and the ground terminal, wherein the gate output enable signal is connected to a common gate connection terminal of the PMOS transistor and the NMOS transistor, and an output terminal is connected with a common drain connection terminal of the PMOS transistor and the NMOS transistor.

15. The circuit of claim 14, wherein a capacitor is connected between the output terminal and the ground terminal.

* * * * *